US007554453B2

(12) United States Patent
Snyder et al.

(10) Patent No.: US 7,554,453 B2
(45) Date of Patent: Jun. 30, 2009

(54) WATER ALARM DEVICES, SYSTEMS AND RELATED METHODS

(75) Inventors: Graham E. Snyder, Raleigh, NC (US); Courtney Hopkins Mann, Raleigh, NC (US)

(73) Assignee: Thermocline Ventures LLC, Raleigh, NC (US)

( * ) Notice: Subject to any disclaimer, the term of this patent is extended or adjusted under 35 U.S.C. 154(b) by 327 days.

(21) Appl. No.: 11/615,447

(22) Filed: Dec. 22, 2006

(65) Prior Publication Data

US 2008/0150733 A1 Jun. 26, 2008

(51) Int. Cl.
*G08B 17/10* (2006.01)
*G08B 23/00* (2006.01)
*G08B 1/00* (2006.01)

(52) U.S. Cl. ..... 340/604; 340/573.6; 340/309.16

(58) Field of Classification Search ..... 340/604, 340/573.6, 309.16
See application file for complete search history.

(56) References Cited

U.S. PATENT DOCUMENTS

| | | | | |
|---|---|---|---|---|
| 3,798,629 | A | 3/1974 | de La Taillade et al. | |
| 3,810,146 | A | 5/1974 | Lieb | |
| 4,527,504 | A | 7/1985 | Byerley | |
| 4,714,914 | A | 12/1987 | Boe | |
| 4,763,077 | A | 8/1988 | Miller | |
| 4,853,691 | A | 8/1989 | Kolbatz | |
| 4,918,433 | A | 4/1990 | Moore | |
| 5,029,293 | A | 7/1991 | Fontanille | |
| 5,030,152 | A | 7/1991 | Carr et al. | |
| 5,049,859 | A | 9/1991 | Arnell | |
| 5,091,714 | A | 2/1992 | de Solminihac | |
| 5,097,254 | A | 3/1992 | Merrithew | |
| 5,109,322 | A | 4/1992 | Loughlin | |
| 5,138,300 | A | 8/1992 | Chance | |
| 5,144,285 | A | 9/1992 | Gore | |
| 5,408,222 | A * | 4/1995 | Yaffe et al. | 340/604 |

(Continued)

FOREIGN PATENT DOCUMENTS

| | | |
|---|---|---|
| CA | 2526342 | 4/2007 |

(Continued)

OTHER PUBLICATIONS

International Search Report and Written Opinion for PCT/US2007/025895, dated May 15, 2008.

*Primary Examiner*—Daniel Wu
*Assistant Examiner*—Jack Wang
(74) *Attorney, Agent, or Firm*—Myers Bigel Sibley & Sajovec

(57) ABSTRACT

A water alarm device for releaseable attachment to a user in a body of water includes a buoyant alarm unit having a water sensor. The water sensor is configured to sense if a sensing portion of the alarm unit is in contact with water. A release unit is configured to releasably attach the alarm unit to the user. A timer is in communication with the water sensor and is configured to determine a duration of water contact with the sensing portion of the alarm unit. The release unit is configured to release the alarm unit from the user when the duration of water contact is greater than a predetermined time, and the alarm unit is configured to travel to a surface of the body of water and activate an alarm when the alarm unit is released from the user.

24 Claims, 9 Drawing Sheets

U.S. PATENT DOCUMENTS 5,463,598 A 10/1995 Holland et al.
5,486,814 A 1/1996 Quinones
5,520,486 A 5/1996 Van Wyck
5,619,187 A 4/1997 Serfontein
5,710,989 A 1/1998 Flood
5,748,080 A 5/1998 Clay
5,832,547 A 11/1998 Burroughs
5,886,635 A 3/1999 Landa et al.
5,907,281 A 5/1999 Miller, Jr. et al.
5,910,772 A 6/1999 Hui
5,917,413 A 6/1999 Malin
5,923,263 A 7/1999 Rodriguez
5,945,912 A 8/1999 Guldbrand
6,064,309 A * 5/2000 Sellers et al. ..... 340/573.6
6,111,510 A 8/2000 Coffelt, Jr.
6,129,036 A 10/2000 King et al.
6,130,615 A 10/2000 Poteet
6,133,838 A 10/2000 Meniere
6,154,140 A 11/2000 Thorpe et al.
6,157,303 A 12/2000 Bodie et al.
6,246,329 B1 6/2001 King et al.
6,317,050 B1 11/2001 Burks
6,327,220 B1 12/2001 Miller, Jr. et al.
6,476,721 B1 11/2002 Diebold
6,583,724 B1 6/2003 Rodriguez
6,642,847 B1 11/2003 Sison
6,767,267 B2 7/2004 Miller
6,786,784 B2 9/2004 Charte
6,802,071 B2 10/2004 Saito et al.
6,843,694 B2 * 1/2005 Simmons ..... 441/89
2003/0139103 A1 7/2003 Charte
2004/0095248 A1 5/2004 Mandel
2006/0012483 A1 1/2006 Ethington
2008/0146105 A1 * 6/2008 Haselsteiner ..... 441/123
2008/0150733 A1 * 6/2008 Snyder et al. ..... 340/573.6

FOREIGN PATENT DOCUMENTS

JP 02241890 A 9/1990
JP 09095298 A 4/1997
JP 2001184574 7/2001
WO WO 2004/072922 8/2004

* cited by examiner

WATER ALARM DEVICES, SYSTEMS AND RELATED METHODS

FIELD OF THE INVENTION

The present invention relates to water alarms and, in particular, to wearable drowning alarm devices and systems.

BACKGROUND OF THE INVENTION

Seven thousand people in the United States die every year from drowning. An additional 4,200 are hospitalized for non-fatal drowning. (Nonfatal and Fatal Drownings in Recreational Water Settings—United States, 2001-2002 *JAMA*. 2004; 292:164-166.) Drowning is the most common cause of accidental death in children under 14 years old (National Safety Council http://www.aloha.com/~lifeguards/kipc.html). Many children are non-swimmers and die as a result of falling into pools or off of boats; however, many children and adults who are swimmers die either from panic, exhaustion, cramps, seizures or a combination thereof. Children may drown despite being supervised while swimming. The parents or other adults supervising the child may have "just looked away for a second" only to find the child drowned on the bottom of the pool.

Several attempts have been made to address water safety with various degrees of success. For the non-swimmer, such as a toddler, the Safety Turtle™ device (Terrapin Communications Inc., Ottawa, Canada) is a bracelet, which when submerged triggers a pool-side alarm to activate and to notify that a person has fallen into the water. Although the Safety Turtle™ device is excellent at detecting a person falling into the water, it may not be suitable for a child who is allowed to play in the water because the Safety Turtle™ device will generally activate in the course of normal play whenever the child's arm is submerged and produce false alarms.

Another approach taken to prevent drowning is to place an alarm on the pool itself. When a pool sensor detects entrance into the pool an alarm is activated. This alarm may be useful if the pool is empty, but is not suited for use with a child who is allowed to play in the pool. This device may not be easily transferred from one pool to another and may not be suitable for use in lakes or oceans.

Japanese Patent Publication No. 02241890 proposes a necklace, which when submerged would inflate and pull the drowning person to the surface by his/her neck. This may present a possibility of strangulation from the device itself. Because the device uses compressed air, it may only be used once. In addition, the amount of compressed air to float a person to the surface may entail a substantial amount of weight. Finally, the necklace could float to the surface and the user's head (which may be unconscious) might still be under water.

U.S. patent application Publication 2004/0095248 to Mandel proposes a device that is worn as a headband. When the device is submerged for a predetermined amount of time, it produces an ultrasonographic signal to be detected by sensors in the side of the pool to notify of a drowning person. This device is configured to transmit signals that propagate through water and is apparently dependent on a poolside receiver to detect ultrasonographic signals reliably. U.S. Pat. No. 4,714,914 to Boe proposes a wearable device, which when submerged will activate (or deactivate) a radio frequency alarm. Both devices may be limited by the power of the RF transmitter and the tremendous decrease in range and reliability that occurs when transmitters send a signal through a water/air interface.

Other devices, such as U.S. Pat. No. 5,097,254 to Merrithew, depend on a pressure sensor to detect submersion for prolonged amounts of time. Pressure sensors may present a reliability problem because the difference in pressure difference between 3 inches below water and 18 inches below water are small and difficult to accurately detect or calibrate. However, even if calibrated correctly, a device that is six inches under water could indicate normal activity or it could indicate a drowning situation depending on where the device is worn, how long it has been submerged, etc. The calibration of such a device may become inaccurate over time due to normal wear on the device or changes in temperature.

Accordingly, there remains a need for a device for detecting potential drowning in users such as children who are permitted to have some water contact during the course of normal activities or play.

SUMMARY OF THE INVENTION

According to embodiments of the present invention, a water alarm device for releaseable attachment to a user in a body of water includes a buoyant alarm unit having a water sensor. The water sensor is configured to sense if a sensing portion of the alarm unit is in contact with water. A release unit is configured to releasably attach the alarm unit to the user. A timer is in communication with the water sensor and is configured to determine a duration of water contact with the sensing portion of the alarm unit. The release unit is configured to release the alarm unit from the user when the duration of water contact is greater than a predetermined time, and the alarm unit is configured to travel to a surface of the body of water and activate an alarm when the alarm unit is released from the user.

According to further embodiments of the invention, a water alarm system includes an alarm base station configured to provide an audible alarm when an alarm activation signal is received. A water alarm device includes a buoyant alarm unit having a water sensor. The water sensor is configured to sense if a sensing portion of the alarm unit is in contact with water. A release unit is configured to releasably attach the alarm unit to the user. A timer is in communication with the water sensor and is configured to determine a duration of water contact with the sensing portion of the alarm unit. The release unit is configured to release the alarm unit from the user when the duration of water contact is greater than a predetermined time. The alarm unit is configured to travel to a surface of the body of water and transmit the alarm activation signal to the alarm base station when the alarm unit is released from the user.

According to embodiments of the present invention, a water alarm device for releaseable attachment to a user in a body of water includes a buoyant alarm unit having a gas flow sensor. The gas flow sensor is configured to sense if gas is flowing in a breathing pattern in an underwater breathing device. A release unit is configured to releasably attach the alarm unit to the user. A timer is in communication with the water sensor and is configured to determine a duration of time without a breathing pattern. The release unit is configured to release the alarm unit from the user when the duration without a breathing pattern is greater than a predetermined time, and the alarm unit is configured to travel to a surface of the body of water and activate an alarm when the alarm unit is released from the user.

According to further embodiments of the invention, a method for reducing a risk of drowning in a user in a body of water includes releasably attaching a buoyant alarm unit to the user. The buoyant alarm unit has a water sensor thereon.

The water sensor senses if a sensing portion of the alarm unit is in contact with water. A duration of water contact with the sensing portion of the alarm unit is determined. The alarm unit is released from the user when the duration of water contact is greater than a predetermined time. An alarm is activated by the alarm unit when the alarm unit is released from the user.

DETAILED DESCRIPTION OF THE INVENTION

Figure 1:
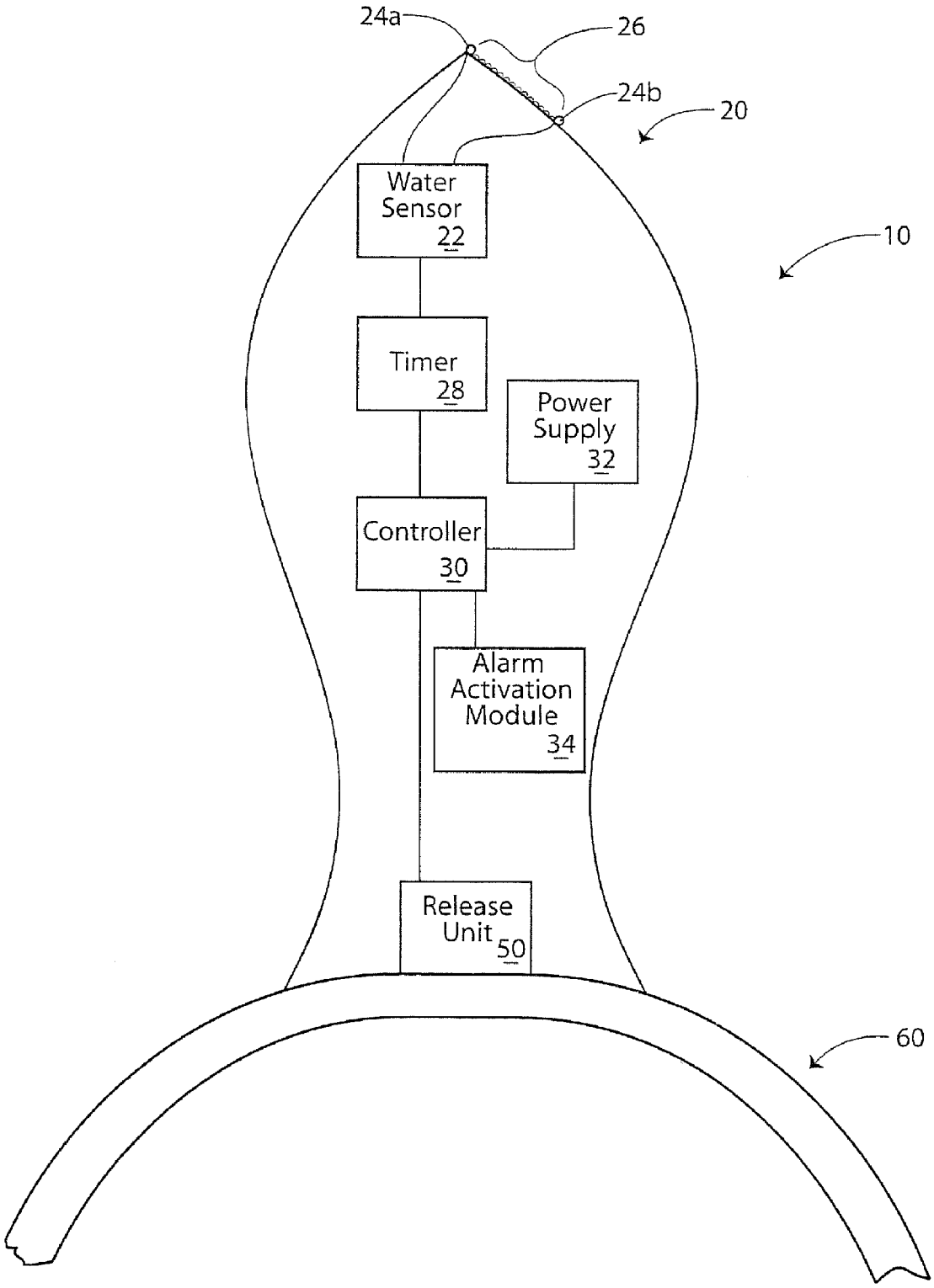
FIG. 1 is a schematic cut-away drawing of a drowning alarm device according to embodiments of the present invention.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness and scale of certain lines, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

The present invention is described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks. Various electronic controllers may be used, including integrated circuits.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

As shown in FIG. 1, a water alarm device 10 includes a buoyant alarm unit 20 that is releasably attached to a necklace 60 by a release unit 50. The alarm unit 20 includes a water sensor 22, a timer 28, a power supply 32, a controller 30 and an alarm activation module 34. The water sensor 22 has two electrodes 24*a*, 24*b* that are spaced apart by a gap 26. As shown in FIGS. 2A-2C and FIGS. 3A and 3B, the device 10 is wearable by a user 70 by placing the necklace 60 around the neck of the user 70.

As shown in FIG. 1, the water sensor 22 senses whether the portion of the alarm unlit 20 that includes the electrodes 24*a*, 24*b* is in contact with water. The release unit 50 is configured to releasably attach the alarm unit 20 to a user. The timer 28 is in communication with the water sensor 22 and is configured to determine a duration of water contact with a portion of the alarm unit 20. If the water contact is greater than a predetermined time, the controller 30 activates the release unit 50 so that the release unit 50 detaches or releases the alarm unit 20 from the user. The alarm unit 20 is buoyant such that, when released, it travels to the surface of the water. For example, a portion of the alarm unit 20 can be formed of a material that floats, such as materials that are less dense than water, such as foam, or materials that can be formed into devices including hollow cavity, such as inflatable plastic, molded plastic, glass, metal or rubber. In some embodiments, the device 10 may include a material that is denser than water, and another substance or air inside the device 10 to maintain buoyancy. In some embodiments, the alarm unit 20 is non-uniformly buoyant, for example, so that the alarm unit 20 has a propensity to float with a particular orientation, such as with the electrodes 24*a*, 24*b* above the water surface.

When the alarm unit 20 is released and reaches the surface, the controller 30 activates the alarm activation module 34. In this configuration, an alarm and/or an alarm activation signal may be produced at the surface of a body of water without requiring more powerful underwater signals. In other embodiments, the alarm and/or alarm activation signal is activated while the alarm unit 20 is underwater and/or simultaneously with the release of the alarm unit 20.

Figure 2A:
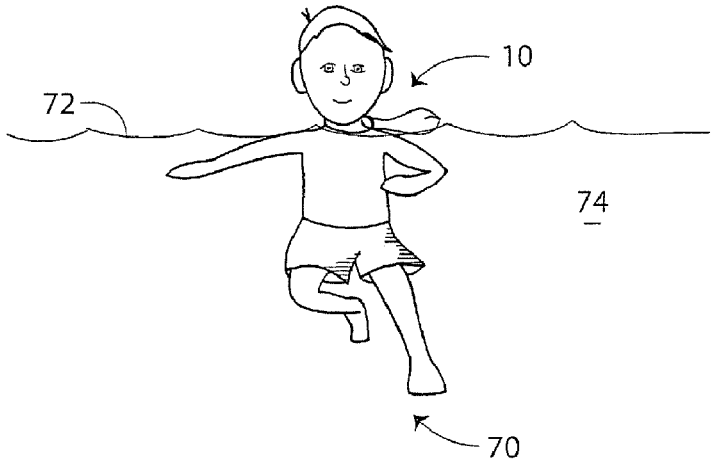
FIGS. 2A-2C illustrate the drowning alarm device of FIG. 1 in an exemplary use environment on a non-drowning swimmer.
Figure 2B:
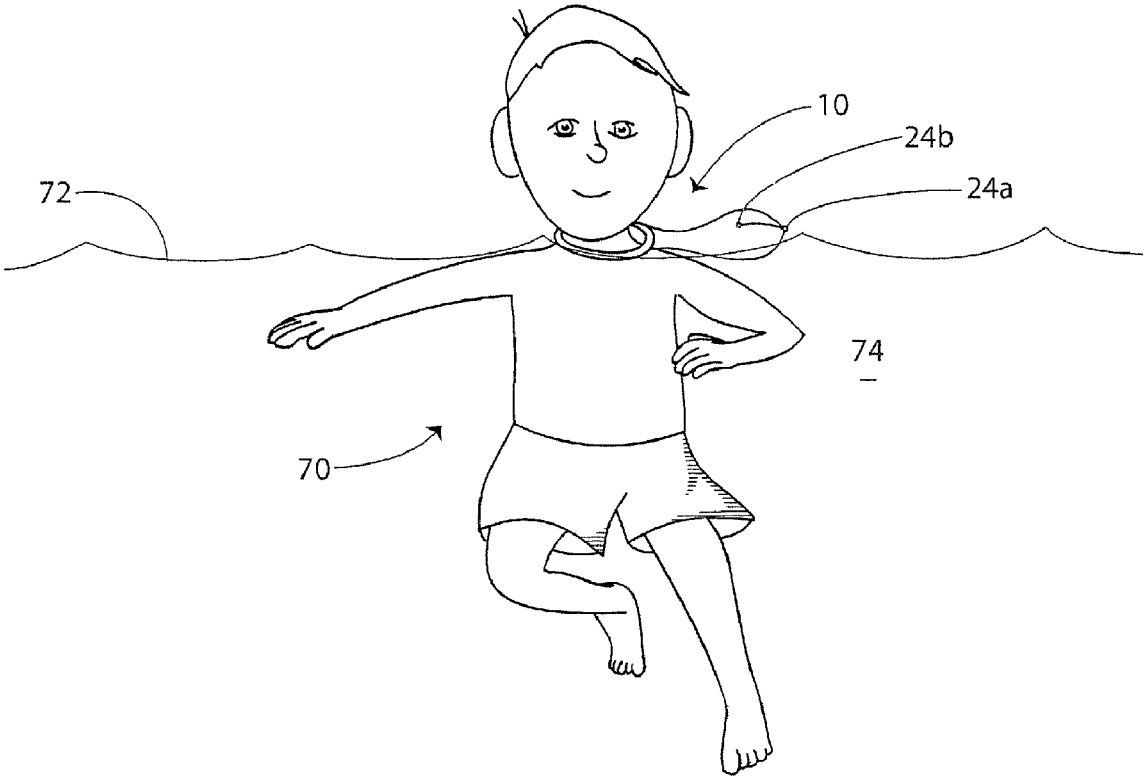
Figure 2C:
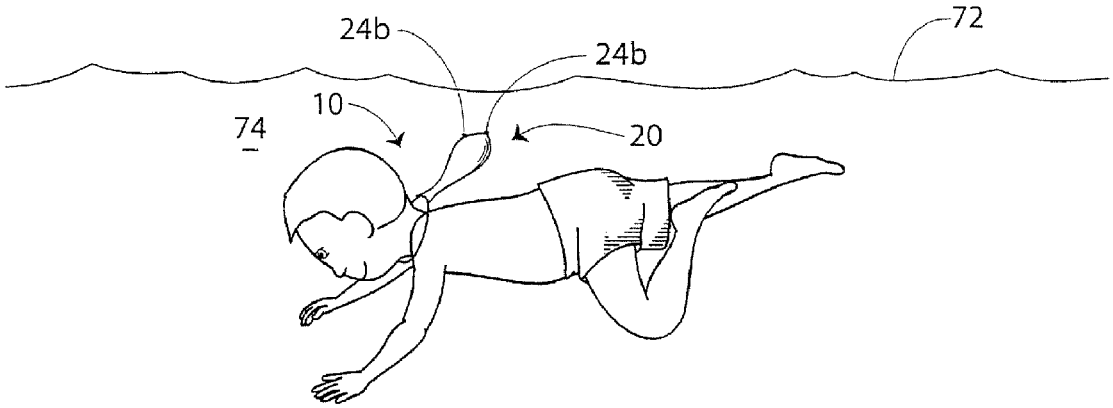

As shown in FIGS. 2A-2C, the buoyant alarm unit 20 generally floats on a surface 72 of a body of water 74 when a user 70 is swimming so that the electrodes 24A, 24B of the water sensor 22 are typically not submerged. If the electrodes 24A, 24B are in contact with the water 74, the timer 28 of FIG. 1 determines the duration of the water contact. For example, as shown in FIG. 2C, if the duration of the water contact is less than a predetermined amount of time, the alarm unit 20 remains attached to the user 70 by the release unit 50 and the necklace 60 even if the alarm unit 20 is submerged.

Figure 3A:
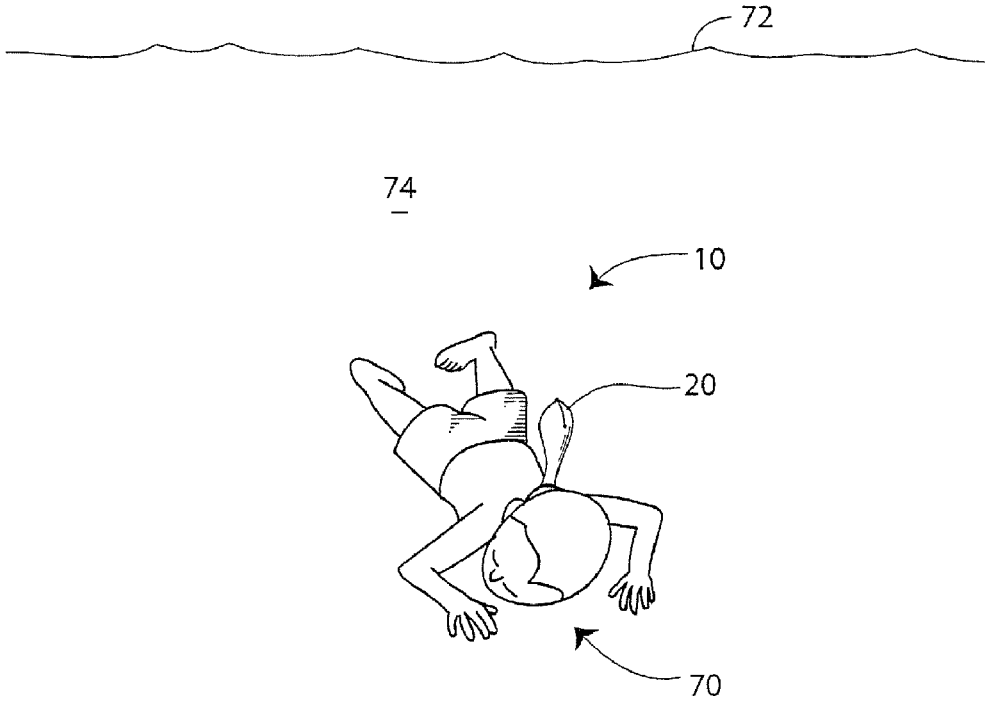
FIGS. 3A-3B illustrate the drowning alarm device of FIG. 1 in an exemplary use environment on a drowning swimmer.

As shown in FIG. 3A, if the duration of the water contact is more than the predetermined amount of time, it may signify the occurrence of a drowning or near-drowning event. If the timer 28 determines that there is prolonged water contact for a duration greater than the predetermined time, the controller 30 (FIG. 1) activates the release unit 50 and the alarm activation module 34 as discussed above so that the buoyant alarm unit 20 travels to the surface 72 of the water 74 as shown in FIG. 3B.

In some embodiments, the predetermined amount of time (after which the release unit 50 and alarm activation module 34 are activated) is generally selected so that relatively brief water contact, as may occur during normal water-related activities, will not activate the alarm activation module 34 or the release unit 50. In addition, the timer 28 generally determines a duration of continuous water contact. That is, the timer 28 may reset a counter when the sensing portion of the water sensor 22 is not in contact with water. In particular embodiments, the predetermined amount of time may be adjusted, for example, based on the age of the user 70. For example, if the user 70 is a young child, such as under age 3 or 4, the predetermined amount of time may be relatively short, such as thirty or sixty seconds. However, if the user 70 is an older child, such as over age 3 or 4, then the predetermined time may be longer (e.g., sixty or ninety seconds) to allow longer submersion times with reduced false alarms for an older, more proficient swimmer. In some embodiments, the predetermined time may be adjusted based on the individual skill level of the user 70 or it may be sold in different models appropriate for different ages and/or swimming skill levels. In some embodiments, the user 70 can be a child under age 18. In particular embodiments, the user 70 can be a child under age 5.

Figure 3B:
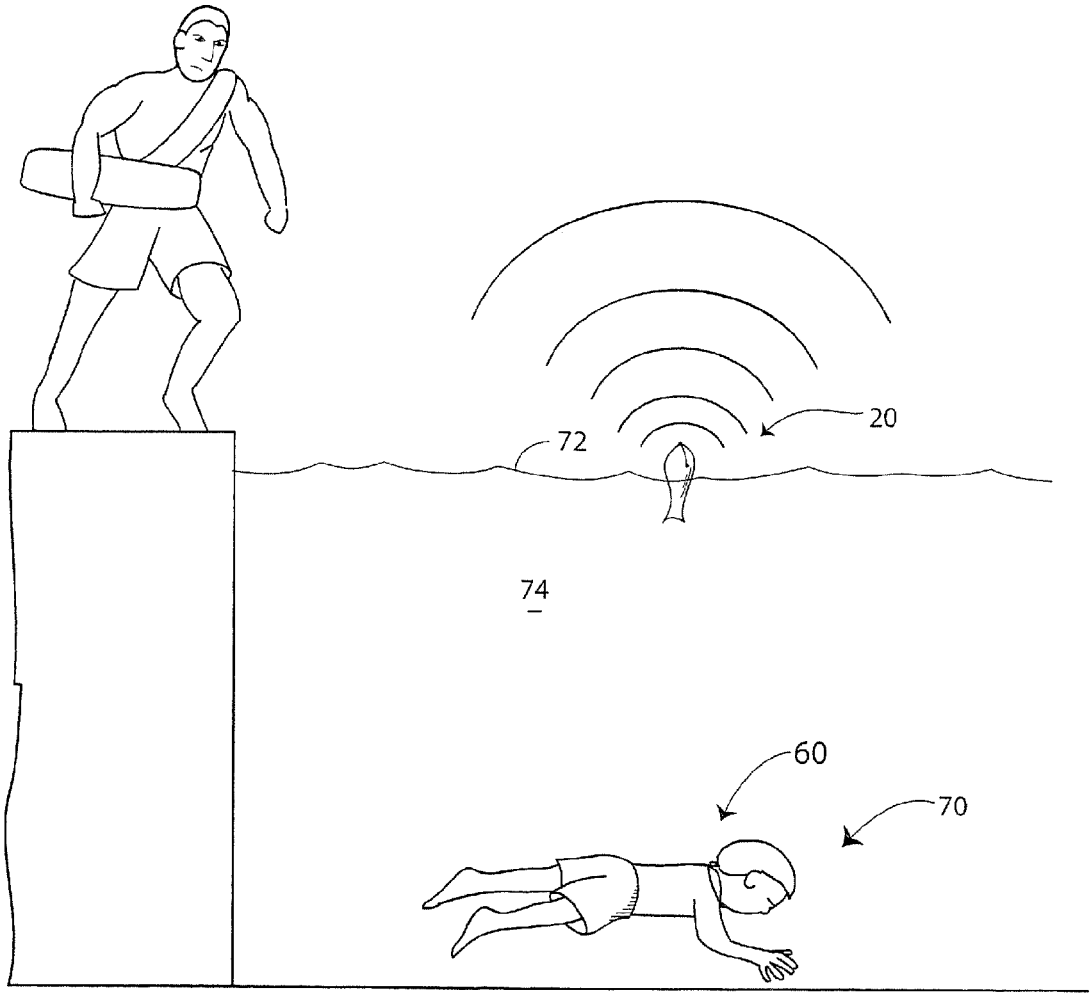
Figure 4:
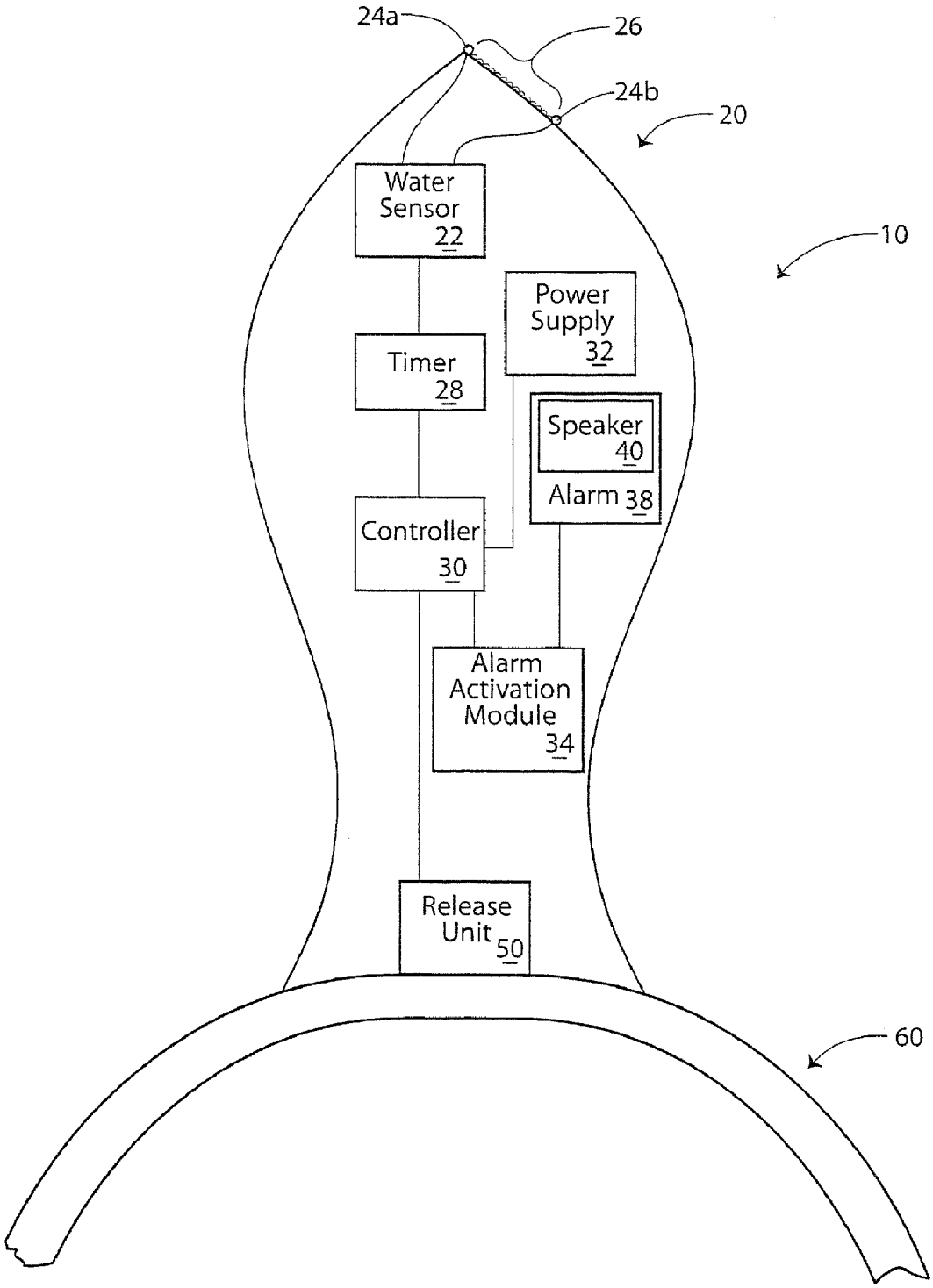
FIG. 4 illustrates a drowning alarm device with an integral alarm according to embodiments of the present invention.
Figure 5:
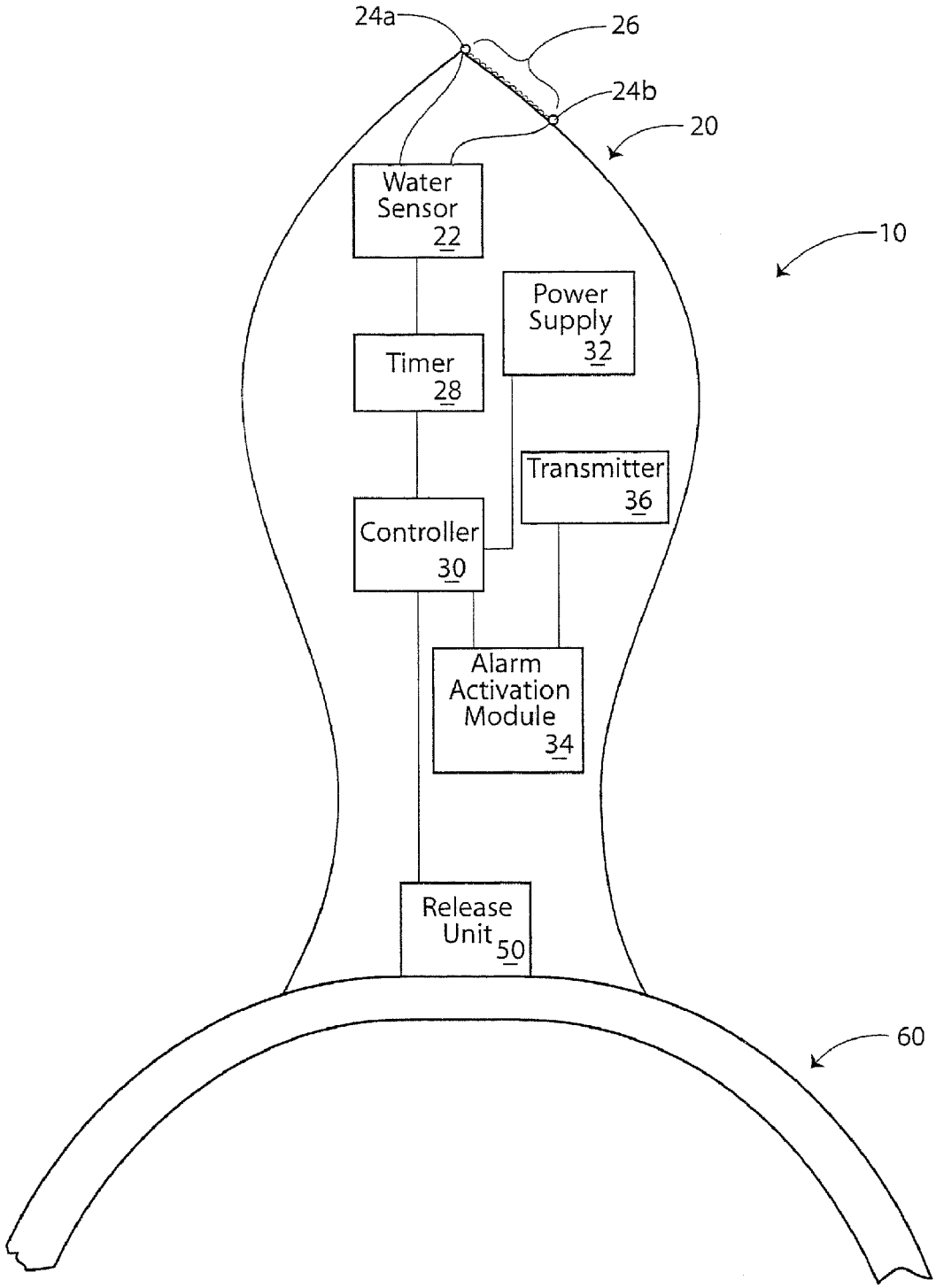
FIG. 5 illustrates a drowning alarm device with an alarm activation module and transmitter according to embodiments of the present invention.
Figure 6:
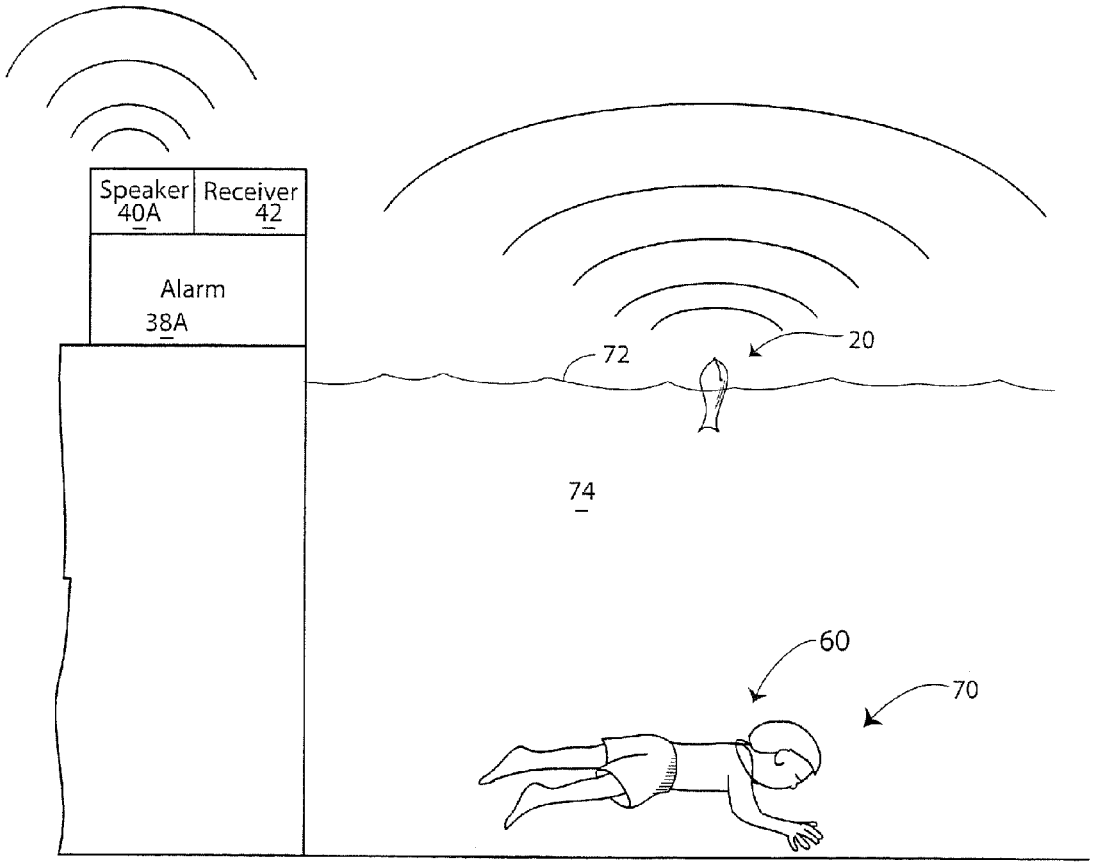
FIG. 6 illustrates the drowning alarm device of FIG. 5 in an exemplary use environment in which the device transmits an alarm activation signal to a separate alarm.

As illustrated in FIG. 3B, the alarm unit 20 can emit an alarm or alarm activation signal from the surface 72 of the water 74. For example, as shown in FIG. 4, the alarm unit 20 can include an alarm 38 that has a speaker 40 so that an audible alarm is emitted from the surface 72 of the water 74 as shown in FIG. 3B. As shown in FIG. 5, the alarm unit 20 can include a transmitter 36 in communication with the alarm activation module 34 so that, as shown in FIG. 6, an alarm activation signal is emitted from the alarm unit 20. An alarm 38A with a speaker 40A and receiver 42 may be positioned near the body of water 74 so that the speaker 40A is activated when the receiver 42 receives the alarm activation signal. The alarm activation signal can be a radio frequency (RF), ultrasonic, sound, light or infrared signals. Because the alarm activation signal is transmitted from the surface 72, the signal travels generally through air rather than water, and a less powerful signal may be used. For example, signals that propagate through water generally require lower frequencies at higher power, and signals that propagate through air can use both high and low frequencies and substantially lower power. Because the alarm activation signal is transmitted from the surface 72, the signal travels generally through air rather than water, and a less powerful signal may be used. However, in some embodiments, an optional alarm signal travels through the water in case the alarm unit 50 does not make it all the way to the surface of the water.

Figure 10:
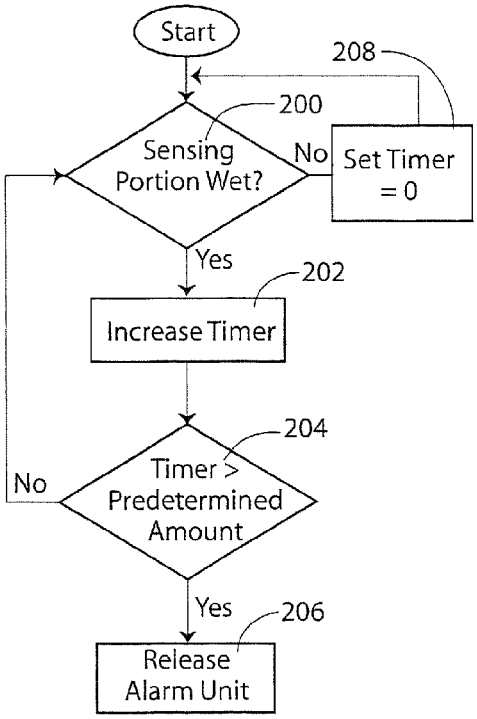
FIGS. 10-11 are flowcharts illustrating operations according to embodiments of the present invention.

According to operations according to embodiments of the invention shown in FIG. 10, the controller 30 of FIGS. 1, 4 and 5 queries whether the sensing portion of the water sensor 22 is in contact with water (Block 200). If the sensing portion of the water sensor is in contact with water, the timer 28 increases a counter that counts the duration of water contact, for example, by one second (Block 202). If the timer 28 determines that the total duration of water contact is greater than the predetermined time (Block 204), then the release unit 50 is activated (Block 206). If the timer 28 determines that the total duration of water contact is less than the predetermined time (Block 204), then the controller 30 queries whether the sensing portion of the water sensor 22 is in contact with water (Block 200). If the sensing portion of the water sensor 22 is not in contact with water (Block 200), the timer 28 resets the counter to zero (Block 208).

Those skilled in the art will recognize that the device 10 can take other configurations without departing from the invention. For example, although the alarm unit 20 is illustrated as a single unit, other configurations may be used. The alarm unit 20 may include a plurality of discrete portions. As a particular example, the water sensor 22 may be provided separately from the alarm activation module 34. In addition, other functionalities such as on/off switches or buttons may be provided. In addition, the power supply 32 of the alarm unit 20 may be automatically switched from an off, low power or hibernation mode to a higher or fully powered mode when the sensing portion of the alarm unit 20 comes in contact with water. After no water contact is detected for a period of time, such as five or 10 minutes, the power supply 32 may be automatically switched back to an off, low-power or hibernation mode. Low battery notification, such as with an LED, may also be provided.

Although the alarms 38, 38A and/or alarm activation module 34 are illustrated in FIGS. 1 and 4-6 as audible alarms, it should be understood that any suitable alarm or notification system may be used to indicate a potential drowning event. For example, the alarm may notify responsible persons that a potential drowning event is occurring using visual effects (such as dye, lights, smoke, pyrotechnic effects, etc.). Ultrasonic or radio frequency signals may be transmitted to a separate alarm or pager. For example, the alarm 38A of FIG. 6 may be a wearable alarm, such as a vibration alarm or pager that may be worn by a person as a bracelet, necklace, clip or other suitable portable configuration.

Figure 7:
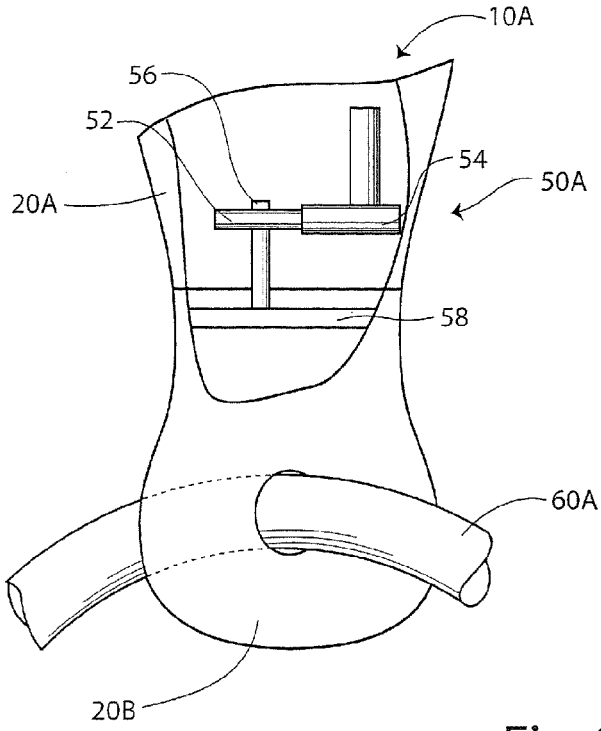
FIG. 7 is a schematic drawing of a release unit according to embodiments of the present invention.

An exemplary release unit 50A is shown in FIG. 7. The alarm unit 20A includes a detachable portion 20B. The release unit 50A includes a pin 52 that can be retracted into a housing 54. The pin 52 extends through a peg 56 that is anchored in the detachable portion 20B by an anchor 58. The controller (not shown) can activate the release unit 50A by causing the pin 52 to retract from the peg 56 into the housing 54. The detachable portion 20B is then detached from the alarm unit 20A. However, any suitable release unit can be used to selectively release the alarm unit from the user, including any suitable cooperating interlocking pieces that are moveable between a locked and unlocked position, including a solenoid or a servo using a locking and unlocking pin, a magnetic attachment, or a spring-loaded trigger device which could both release the device and/or move the alarm unit 20 clear of the necklace 60 at the time of deployment.

Any suitable water sensor may be used as the water sensor 22 of FIGS. 1, 4 and 5, including, but not limited to those that detect a difference between the resistance, conductance, capacitance or ability to transmit a signal between air and water. For example, as illustrated in FIG. 1, the gap 26 conducts electricity when it is in contact with water, but is non-conductive if the gap 26 is not in contact with water. The water sensor 22 generates a small voltage (e.g. about 1-10 V, or about 6 V) to one of the electrodes 24*a*, 24*b* and detects whether a current is present in the other of the electrodes 24*a*, 24*b* to determine if the gap 26 is in contact with water. When the electrodes 24*a*, 24*b* are exposed to air, the resistance between the electrodes 24*a*, 24*b* is high, and the current detected is substantially zero. However, if the electrodes 24*a*, 24*b* are exposed to freshwater or saltwater, a current is detected. For example, the current can be about 1 microamp in clean fresh water to about 1.5 amps in sea water.

The necklace 60 of FIGS. 1, 4 and 5 may have a length and/or buoyancy such that the device may be completely submerged only when the user's nose and mouth are submerged. The alarm unit 20 can slide around the necklace 60 such that the electrodes 24*a*, 24*b* are generally at the most buoyant point. The necklace 60 may be configured so that it is unlikely to bunch up and/or be submerged when the user 70 is near the surface 74, for example, if the alarm unit 20 is pushed underwater by the orientation of the necklace 60.

Although the device 10 is illustrated as being attached to a user 70 by a necklace 60, it should be understood that any suitable attachment may be used. For example, the device 10 can be incorporated in to a bracelet, a barrette, a headband, a clip or safety pin for attaching the device 10 to clothing, or other wearable configurations. Although the alarm unit 20 is illustrated as in the general shape of a fish, any shape may be used, including decorative shapes, action figures and/or colors that may be appealing to users such as children. In some embodiments, the device 10 can be reused by reattaching the alarm unit 20 to the release unit 50. Additional maintenance or steps to reset the device 10 for additional use may not be needed.

The alarm unit 20 generally travels to the surface 72 because the unit 20 is buoyant. However, propellers, movable fins balloons, $CO_2$ canisters or other propulsion devices can be used to propel the alarm unit 20 to the surface.

In some embodiments, the device 10 can include an indicator (not shown), such as a LED or other light, that indicates to a user whether the power supply 32 is properly charged.

Figure 8:
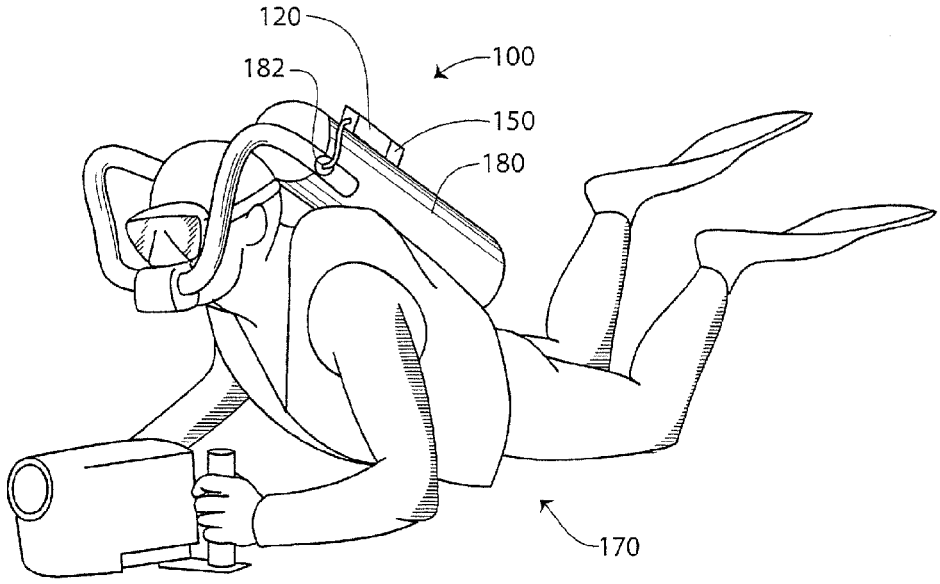
FIG. 8 illustrates an exemplary use environment of a drowning alarm device on a scuba diver according to embodiments of the present invention.
Figure 9:
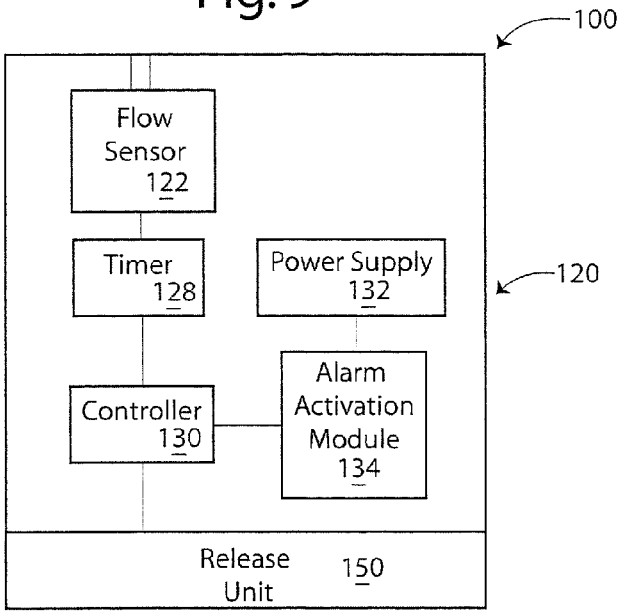
FIG. 9 is a schematic diagram of the drowning alarm device of FIG. 8.

Although the device 10 is illustrated as having a water sensor 22 for detecting potential drowning events, other sensors may be used. For example, as shown in FIG. 8, a device 100 is releasably attached to a user or scuba diver 170. The diver 170 is wearing scuba equipment that includes an air or gas tank 180 and an air flow regulator 182. The device 100 includes an alarm unit 120 that is releasably attached to the tank 180 by a release unit 150. As shown in FIG. 9, the alarm unit 120 includes an air flow sensor 122, a timer 128, a controller 130, a power supply 132 and an alarm activation module 134. That air tank 180 may contain any breathable gas. The timer 128 determines the amount of time during which there is an air flow pattern in the flow regulator 182 that indicates potential breathing difficulties. For example, an example of a breathing flow pattern is a pulsed flow of air at about six to about sixty breaths per minute, which is consistent with breathing and does not indicate that difficulties have occurred. However, it a continuous flow of air is detected, then the regulator or mouthpiece may have been removed from the mouth of the diver 170. This is an example of the absence of a breathing flow pattern. In this case, the diver 170 may have plenty of air in the tank, but not have access to the regulator. No or reduced airflow may also indicate breathing difficulties. If the duration of an airflow pattern indicating potential breathing difficulties is greater than a predetermined amount, such as 40 seconds, this may indicate that the diver 170 is actually having difficulty breathing. The controller 130 then activates the release unit 150 to release from the tank 180 and activates the alarm activation module 134. The alarm unit 120 travels to the surface of the water and the alarm activation module 134 activates an alarm (not shown). The alarm can be integrated into the alarm unit 120 or the alarm may be separate from the alarm unit 120 as shown with respect to FIGS. 4 and 5. In this configuration, the device 100 rises to the surface and provides a notification that a diver may have difficulty breathing.

Figure 11:
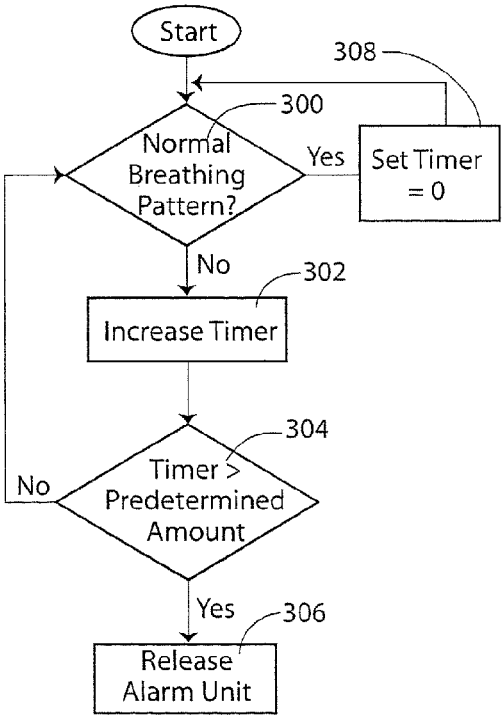

As shown in FIG. 11, the controller 130 of FIG. 9 queries whether the sensor 122 senses flow (Block 300). If the flow sensor 122 indicates a flow pattern indicative of breathing difficulties, the timer 128 increases a counter that counts the duration, for example, by one second (Block 302). If the timer 128 determines that the total duration of the flow pattern indicative of breathing difficulties is greater than the predetermined time (Block 304), then the release unit 150 is activated (Block 306). If the timer 128 determines that the total duration is less than the predetermined time (Block 304), then the controller 130 queries whether the sensor 122 senses normal flow, such as pulsed breathing (Block 300). If the sensor 122 senses normal airflow (Block 300), the timer 128 resets the counter to zero (Block 308).

Although the devices 10, 100 are illustrated as being in use on a person, the alarm units 20, 120 and release units 50, 150 of the devices 10, 100 may be adapted for use on inanimate objects, such as boats, buoys, docks, or buildings to detect sinking or other water events such as flooding.

The alarm units 20, 120 and release units 50, 150 of the devices 10, 100 may be any suitable size. For example, an alarm unit 20 on a child as shown in FIGS. 2A-2C and 3A-3B may be about 1-2 inches long, or in some embodiments, about 1.5 inches long. The necklace 60 may be formed of an elastic material and/or be configured to lay close to the user's neck to reduce the chances of entanglement and/or strangulation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A water alarm device for releaseable attachment to a user in a body of water, the device comprising: a buoyant alarm unit including a water sensor, the water sensor being configured to sense if a sensing portion of the alarm unit is in contact with water; a release unit configured to releasably attach the alarm unit to the user; a timer in communication with the water sensor and configured to determine a duration of water contact with the sensing portion of the alarm unit; wherein the release unit is configured to physically release the alarm unit from the user such that the release unit is not physical connected to the user when the duration of water contact is greater than a predetermined time; and wherein the alarm unit is configured to travel to a surface of the body of water and activate an alarm when the alarm unit is released from the user.

2. The water alarm device of claim 1, wherein the duration of water contact is substantially continuous.

3. The water alarm device of claim 1, wherein the release unit comprises a necklace, and the buoyant alarm unit is releasably attached to the necklace by the release unit.

4. The water alarm device of claim 1, wherein the alarm unit includes an alarm transmitter.

5. The water alarm device of claim 4, wherein the alarm transmitter is configured to produce an audible and/or visual signal at the surface of the body of water.

6. The water alarm device of claim 1, wherein the alarm unit includes a transmitter configured to transmit an alarm activation signal at the surface of the body of water to activate the alarm.

7. The water alarm device of claim 6, wherein the alarm unit includes a portable alarm base station.

8. The water alarm device of claim 1, wherein the water sensor is configured to sense if the sensing portion of the alarm unit is in contact with water when the alarm unit is substantially submerged.

9. The water alarm device of claim 1, wherein the predetermined time is between about 15 seconds and 2 minutes.

10. The water alarm device of claim 1, wherein the predetermined time is adjustable by a user.

11. The water alarm device of claim 1, wherein the alarm unit is sufficiently buoyant so that the alarm unit floats to the surface of the body of water when the alarm unit is detached from the user.

12. The water alarm device of claim 1, wherein the water sensor comprises at least two spaced-apart electrodes and is configured to detect a current between the electrodes when the electrodes are in contact with water.

13. The water alarm device of claim 12, wherein the at least two spaced-apart electrodes are sized and configured so that the current is detected when the alarm unit is substantially submerged and the current is not detected when the alarm unit is partially submerged.

14. The water alarm device of claim 13, wherein the at least two spaced-apart electrodes are sized and configured so that one of the electrodes is not in contact with water when the alarm unit is partially submerged.

15. A water alarm system comprising: an alarm base station configured to provide an audible alarm when an alarm activation signal is received; a water alarm device comprising: a buoyant alarm unit having a water sensor, the water sensor being configured to sense if a sensing portion of the alarm unit is in contact with water; a release unit configured to physically releasably attach the alarm unit to the user; a timer in communication with the water sensor and configured to determine a duration of water contact with the sensing portion of the alarm unit; wherein the release unit is configured to release the alarm unit from the user such that the release unit is not physically connected to the user when the duration of water contact is greater than a predetermined time; and wherein the alarm unit is configured to travel to a surface of the body of water and transmit the alarm activation signal to the alarm base station when the alarm unit is released from the user.

16. The water alarm system of claim 15, wherein the release unit comprises a necklace, and the buoyant alarm unit is releasably attached to the necklace by the release unit.

17. The water alarm system of claim 15, wherein the water sensor is configured to sense if the sensing portion of the alarm unit is in contact with water when the alarm unit is substantially submerged.

18. The water alarm system of claim 15, wherein the predetermined time is between about 15 seconds and 2 minutes.

19. The water alarm system of claim 15, wherein the predetermined time is adjustable by a user.

20. The water alarm system of claim 15, wherein the alarm unit is sufficiently buoyant so that the alarm unit floats to the surface of the body of water when the alarm unit is detached from the user.

21. The water alarm system of claim 15, wherein the water sensor comprises at least two spaced-apart electrodes and is configured to detect a current between the electrodes when the electrodes are in contact with water.

22. The water alarm system of claim 21, wherein the at least two spaced-apart electrodes are sized and configured so that the current is detected when the alarm unit is substantially submerged and the current is not detected when the alarm unit is partially submerged.

23. The water alarm device of claim 22, wherein the at least two-spaced apart electrodes are sized and configured so that one of the electrodes is not in contact with water when the alarm unit is partially submerged.

24. A method for reducing a risk of drowning in a user in a body of water, the method comprising: releasably attaching a buoyant alarm unit to the user, the buoyant alarm unit having a water sensor thereon; sensing with the water sensor if a sensing portion of the alarm unit is in contact with water; determining a duration of water contact with the sensing portion of the alarm unit; physically releasing the alarm unit from the user such that the release unit is not physically connected to the user when the duration of water contact is greater than a predetermined time; and activating an alarm with the alarm unit when the alarm unit is released from the user.

* * * * *